United States Patent [19]

Smith et al.

[11] 4,446,216

[45] May 1, 1984

[54] PHOTOGRAPHIC MATERIAL

[76] Inventors: Norman A. Smith, Hornchurch; Stephen R. Postle; William E. Long, both of Brentwood, all of England

[21] Appl. No.: 444,022

[22] Filed: Nov. 23, 1982

[30] Foreign Application Priority Data

Dec. 10, 1981 [GB] United Kingdom ..... 8137239

[51] Int. Cl.[3] ..... G03C 5/24; G03C 1/02

[52] U.S. Cl. ..... 430/405; 430/441; 430/566; 430/959

[58] Field of Search ..... 430/959, 566, 405, 441

[56] References Cited

U.S. PATENT DOCUMENTS

| | | | |
|---|---|---|---|
| 3,246,988 | 4/1966 | Porter et al. | 430/959 |
| 3,311,476 | 3/1967 | Loria et al. | 430/555 |
| 3,765,897 | 10/1973 | Nittel | 430/546 |
| 4,201,578 | 5/1980 | Abbott | 430/566 |
| 4,330,617 | 5/1982 | Ohashi et al. | 430/959 |

*Primary Examiner*—Mary F. Downey
*Attorney, Agent, or Firm*—Joseph G. Kolodny

[57] ABSTRACT

Photographic material which comprises in at least one silver halide emulsion layer or a layer or layers adjacent thereto at least one substituted hydroquinone compound of the formula

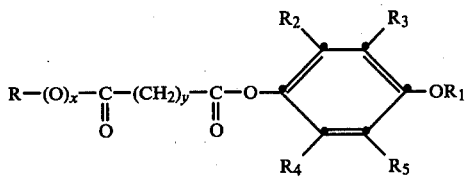

where

R is hydrogen or optionally substituted alkyl, aryl or a heterocyclic group, $R_2$, $R_3$, $R_4$ and $R_5$ are each hydrogen, halogen or optionally substituted alkyl, x is 0 or 1, y is 0 or 1, and $R_1$ is hydrogen or a group of the formula

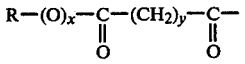

where R, x and y are as just defined.

11 Claims, No Drawings

PHOTOGRAPHIC MATERIAL

This invention relates to photographic material containing substituted hydroquinone compounds.

Hydroquinone is the most widely used developing agent for developing latent silver images in silver halide photographic material. Most usually exposed photographic material is processed in a bath containing hydroquinone to develop the latent image but for some types of processing it is preferable that the hydroquinone is present already in the photographic material which after exposure is processed in an alkali bath to develop the latent image as hydroquinone only acts as a developing agent under alkaline conditions. Such a method of processing is known as activation processing. Activation processing is extremely rapid but it is not widely employed except in certain special circumstances because the disadvantages of incorporating hydroquinone in the photographic material outweigh the advantages. These disadvantages include developer decomposition on ageing and interference with the setting and hardening of the gelatin or other colloidal layers in which it is incorporated during the coating of the photographic material. Further, activation processing often tends to cause stain and tanning of the processed material.

In an effort to overcome these disadvantages it has been proposed to use protected hydroquinones which are substituted hydroquinones in which the protecting group or groups are cleaved at the high pH-value of the alkaline processing bath. However it has proved difficult to find substituted hydroquinones which are readily cleavable in the alkaline bath and thus which release the active hydroquinone quickly enough to achieve rapid processing and also substituted hydroquinones which are stable during coating and on storage of the photographic material. Many of the proposed substituted hydroquinone compounds contain in the protective moiety desensitising groups which limit the use of such compounds, or are coloured due to the presence of chromophoric groups, such as nitro groups, in the protective moiety. Such coloured compounds may be of use in certain circumstances but their presence tends to cause speed losses in the photographic material.

Some of the proposed hydroquinone derivatives are water-insoluble and these compounds comprise comparatively bulky water-insolubilising groups which lead to high coating weights. The presence of high molecular weight components in a layer of photographic material often leads to poor inter-layer or layer/base adhesion and poor layer hardening. Examples of water-insoluble hydroquinone derivatives are given in Research Disclosure 1644 of December 1977.

We have now found substituted hydroquinone compounds which are water-insoluble, cleave rapidly in alkaline solution and exhibit superior storage stability and little tendency to cause stain or tanning problems when material which contains them is activation processed. Furthermore, none of the compounds are coloured nor do they contain any desensitising groups, and all can be formulated easily in photographic layers.

According to the present invention there is provided photographic silver halide material which comprises in at least one silver halide emulsion layer or a layer or layers adjacent thereto at least one substituted hydroquinone compound of the formula

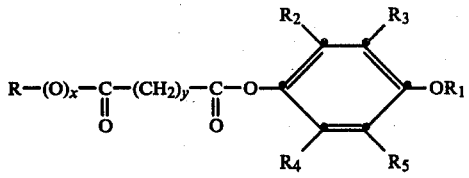

(1)

where

R is hydrogen or optionally substituted alkyl, aryl or a heterocyclic group, $R_2$, $R_3$, $R_4$ and $R_5$ are each hydrogen, halogen or optionally substituted alkyl, x is 0 or 1, y is 0 or 1, and $R_1$ is hydrogen or a group of the formula

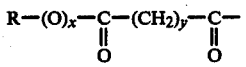

where R, x and y are as just defined.

Other objects of the present invention are a process for the preparation of the inventive material, the use of the hydroquinone compounds in these materials and a method of processing these materials.

R in the compounds of the formula (1) denotes hydrogen or alkyl, preferably having 1 to 18 carbon atoms such as for example methyl, ethyl, propyl, butyl, hexyl, octyl, decyl as well as dodecyl and octadecyl and their isomers. Alkyl groups having 1 to 12 or, more preferably 1 to 8 carbon atoms, are particularly suitable. The alkyl groups R may be further substituted. Suitable substituents are for example alkoxy having 1 to 18 carbon atoms, phenyl, phenoxy, hydroxyl, halogen, amino, N-alkyl- or N,N-dialkylamino where the alkyl radicals preferably contain 1 to 18 carbon atoms. Phenyl and hydroxyphenyl such as p-hydroxyphenyl are the particularly preferred further substituents for the alkyl groups R. R denotes further aryl and is preferably phenyl or biphenyl which radicals can be substituted by those substituents mentioned for the alkyl groups R. R represents also a heterocyclic ring. Preferably, R is a 5- or 6-membered ring which contains a nitrogen or oxygen atom. Suitable examples for heterocyclic rings are pyridine, pyrrolidine and furyl.

$R_1$ is hydrogen or a group of the formula

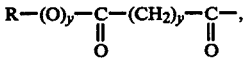

wherein R is as just defined and x and y are each 0 or 1.

$R_2$, $R_3$, $R_4$ and $R_5$ are each hydrogen, halogen such as chlorine or bromine or alkyl, preferably having 1 to 6, and more preferably 1 to 4 carbon atoms. These alkyl groups may be substituted for example by hydroxyl, amino, N-alkyl- or N,N-dialkylamino or halogen, in particular chlorine.

Preferably, in formula (1), each of $R_1$, $R_2$, $R_3$, $R_4$ and $R_5$ are hydrogen.

Preferably R is either alkyl having from 1 to 4 carbon atoms or is optionally substituted aryl.

If R is optionally substituted aryl, most preferably it is p-hydroxy phenyl.

Compounds of formula (1) wherein $R_1$ is hydrogen may be prepared by reacting one mole of an acid chloride of the formula $$R-(O)_x-\underset{\underset{O}{\|}}{C}-(CH_2)_y-\underset{\underset{O}{\|}}{C}-Cl \quad (2)$$

where R, x and y have the meanings assigned to them above with one mole of hydroquinone of the formula

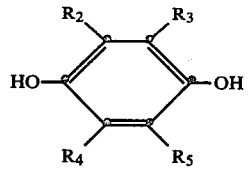

(3)

where $R_2$, $R_3$, $R_4$ and $R_5$ have the meanings assigned to them above, in the presence of a tertiary amine base and an organic solvent.

Compounds of formula (1) where $R_1$ is the group $$R-(O)_x\underset{\underset{O}{\|}}{C}-(CH_2)_y-\underset{\underset{O}{\|}}{C}-$$

as defined above, may be prepared by reacting two moles of the acid chloride of formula (2) with one mole of the hydroquinone of formula (3) in the presence of a tertiary amine base and an organic solvent.

Compounds of formula (1) where R is optionally substituted p-hydroxy phenyl may be prepared by reacting one mole of an acid chloride of the formula $$Cl-\underset{\underset{O}{\|}}{C}-(CH_2)_y-\underset{\underset{O}{\|}}{C}-Cl \quad (4)$$

where y is as defined above, with 2 moles of a hydroquinone of the formula (3) in the presence of a tertiary amine base and organic solvent.

The preferred bases are pyridine and triethylamine.

The amount of the compound of the formula (1) present in the silver halide photographic material will depend on the actual compound used and on the proposed use of the photographic material. Preferably however the compound of the formula (1) is present in the photographic material in an amount within the range of 0.1 to 1.0 moles per 1.5 moles of silver halide present in the photographic material.

Preferably the substituted hydroquinones of the formula (1) are dispersed in the layer of the photographic material as a solid dispersion which has been obtained by ball-milling the solid in an aqueous medium in the presence of a wetting agent. Alternatively the water-insoluble compounds of the formula (1) may be dispersed in the layer of the photographic material in an oil, for example tricresyl phosphate.

The compound of the formula (1) can be incorporated into a silver halide emulsion layer or a layer which is adjacent to this emulsion layer. By adjacent is meant, that the layer is close enough to the emulsion layer to allow the diffusion of the hydroquinone released by reaction of the compound of the formula (1) with the developer into the silver halide emulsion layer (operative contact). If several silver halide emulsion layers are present, the photographic material may also contain several layers adjacent to the emulsion layers. These layers which are adjacent to the emulsion layers preferably contain gelatin as the binder.

Usually silver halide photographic material which is to be activation processed comprises only one silver halide emulsion layer and most usually gelatin is used as the binder.

Therefore according to a preferred embodiment of this aspect of the present invention there is provided photographic silver halide material which comprises coated on a support a gelatino silver halide emulsion layer which comprises a substituted hydroquinone of the formula (1).

The silver halide present in the photographic material may be any one of the normally employed silver halides such as silver chloride, silver bromide, silver chlorobromide, silver bromoiodide and silver iodochlorobromide.

The silver halide emulsions may be optically sensitised by the presence therein of optical sensitising dyes, for example merocyanine or carbocyanine dyes.

The silver halide emulsions may contain any of the additives commonly used in photographic emulsions, for example wetting agents such as polyalkylene oxides, stabilising agents such as tetra-azaindenes, metal sequestering agents and growth or crystal habit modifying agents commonly used for silver halide, such as adenine.

Preferably the colloid medium is gelatin or a mixture of gelatin and a water-insoluble latex of a vinyl acetate-containing polymer. Most preferably if such a latex is present in the final emulsion it is added after all crystal growth has occurred. However, other water-soluble colloids, for example casein, polyvinyl-pyrrolidone or polyvinyl alcohol, may be used alone or together with gelatin.

The support may be any one of the supports normally used for photographic materials including paper base, polyethylene-coated paper base, oriented and subbed polyethylene terephthalate, cellulose triacetate, cellulose acetate butyrate, polystyrene and polycarbonate.

The photographic material of the present invention may be used in a large number of different ways including black and white print material, X-ray film material, colour film material, microfilm products and direct positive material.

The photographic material of the present invention most usually is prepared by forming an aqueous colloid, preferably gelatin coating solution of the silver halide which comprises either a dispersion of at least one compound of the formula (1) or a solution of the compound of the formula (1) and this colloid coating solution is coated as a layer on a support and dried. Alternatively, the photographic material of the present invention is prepared by coating onto a support a silver halide emulsion layer, and adjacent thereto a colloid, preferably gelatin layer which contains at least one compound of the formula (1).

After exposure the photographic material may be treated with an activator solution which is an aqueous alkaline solution which comprises for example sodium hydroxide or sodium carbonate. Most usually the activator solution will have a pH-value of between 10 and 14. Stabilisers, antifoggants and development accelerators may also be present in the activator solutions.

The activator solutions may be applied to the exposed photographic material of the present invention in all the usual ways such as surface application, total immersion of the material in the activator solution and spraying.

After the photographic material of the present invention has been activator processed it may be fixed in a silver halide fixing solution, for example ammonium thiosulphate, to remove the undeveloped silver halide, or it may be stabilised to render the remaining silver halide light insensitive by treatment with a known stabiliser treatment solution, for example an aqueous ammonium thiocyanate solution.

The following Examples will serve to illustrate the invention.

MANUFACTURING INSTRUCTIONS

Preparation I

Preparation of the compound of the formula:

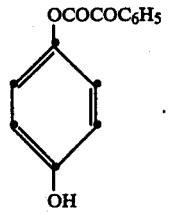

D 3.0 g of hydroquinone and 3.1 ml of pyridine are dissolved in 25 ml of acetone. This mixture is treated dropwise with a solution of 4.2 g of phenylglyoxyloyl chloride in 10 ml of acetone, keeping the temperature at 10°-15° C. with an ice-bath. After addition the mixture is allowed to come to room temperature. Stirring is continued for 5 hours. The solvent is then evaporated in vacuum to leave a viscous amber oil which slowly solidifies on stirring with 50 ml of cold water. The solid is filtered off, washed with cold water and dried under vacuum.

Recrystallisation from a chloroform cyclohexane (1:1) mixture gives 1.9 g of the compound of the formula D. having a melting point of 123°-126° C.

The compound of the formula

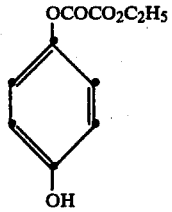

A is prepared similarly using the appropriate acid chloride. Melting point 108°-112° C.

Preparation II

Preparation of the compound of the formula

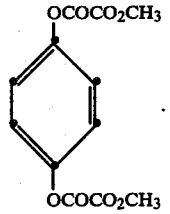

B 11.0 g of hydroquinone are dissolved in 50 ml of acetonitrile containing 16.2 ml of pyridine. This mixture is then treated over 1 hour with a solution of 18.8 ml of methyl oxalyl chloride in 50 ml of acetonitrile allowing the temperature to rise to 30°-35° C. After the addition is complete the solution is refluxed for 1 hour then cooled and poured into 600 ml of ice-water containing 10 ml of concentrated hydrochloric acid. The solid thus formed is filtered, washed well with cold water then dried under vacuum to give 23.7 g of the compound of the formula B having a melting point of 133°-135° C. The product may be further purified, if necessary, by dissolution in warm dichloromethane then adding three volumes of cyclohexane.

Preparation III

Preparation of the compound of the formula

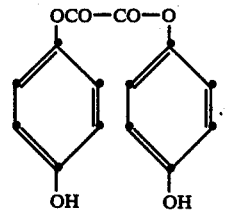

E.

8.8 g of hydroquinone are dissolved in 80 ml of dry acetone containing 3.2 ml of pyridine. The solution is cooled to 10°-15° C. and treated dropwise with 1.75 ml of oxalyl chloride keeping the temperature at 10°-15° C. After stirring for 3 hours at room temperature the solution is filtered and added to 250 ml of ice-cold water. The product thus formed is filtered off, washed well with water and dried in vacuum over $P_2O_5$ to yield 3.5 g of the compound of the formula E having a melting point of 245°-250° C. (dec.).

The compound of the formula

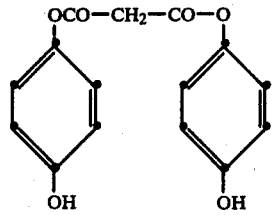

F.

is prepared similarly using the appropriate acid chloride. Melting point 165°-167° C.

The compound of the formula

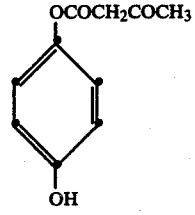

C.

is prepared as described in Journal of the Chemical Society, 1954, page 857. Melting point 98°-99° C.

Preparation IV

Preparation of the compound of the formula

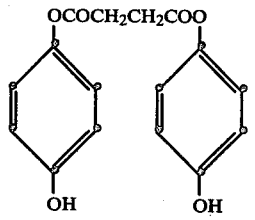

G 6.2 g of succinyl chloride is added to 17.69 of hydroquinone in 150 ml acetone at 7° C. Then 6.4 g of pyridine in 10 ml of acetone is slowly added, keeping the temperature below 10° C. A yellow precipitate appears, but this dissolves on allowing the mixture to warm to room temperature. The solvent is evaporated off, and the residual solid heated briefly to 80° C. in 150 ml of water. The insoluble solid is filtered off, and recrystallised from acetone/water, yield 8 g, melting point 224°-226° C.

Preparation V

Preparation of the compound of the formula

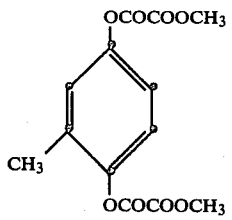

H 2.4 g of methyl oxalyl chloride is added dropwise to 1.24 g of methyl hydroquinone and 1.6 of pyridine in 30 ml of acetone at approx. 10° C. A pink precipitate forms. The mixture is then briefly heated to boiling, then cooled, 10 ml of water are added, and the precipitate dissolves. Further 30 ml of water is then added, and the white solid is filtered off, washed and dried. Yield 2.2 g melting point 99°-101° C.

The compound of the formula

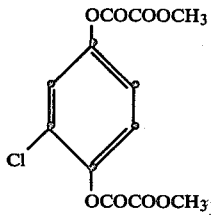

I is prepared as described for compound H, but using 1.45 g of chlorohydroquinone. Melting point 99°-101° C.

Preparation VI

Preparation of the compound of the formula

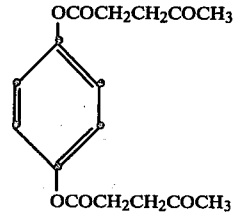

J 4.64 g of laevulinic acid and 4.13 g of dicyclohexylcarbodiimide are stirred in dry ether for 5 hours, and then filtered. The ether is evaporated to give 4.2 g of an oil. 1.1 g of hydroquinone 5 ml of pyridine is added to this oil, and stands overnight. Then 40 ml of water is added, and the precipitate solid recrystallised from isopropanol. Yield 2.02 g, melting point 110°-111° C.

Preparation VII

Preparation of the compound of the formula

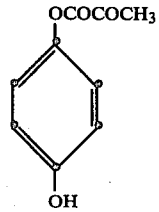

K 1.88 g of pyruvoyl chloride is slowly added to 3.88 g of hydroquinone in 30 ml of acetone (30 ml) at 10° C. 1.39 g of pyridine in 5 ml of acetone is slowly added at below 10° C., and the mixture is allowed to warm to room temperature. After evaporation of the solvent, the yellow oil is taken up in dichloromethane, and extracted 6 times with water. The dichloromethane is evaporated, and the residue triturated with petrol (b.p. 40°-60° C.). A low-melting solid is obtained. Yield 0.49 g.

Preparation VIII

Preparation of the compound of the formula

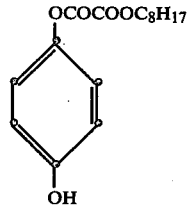

L 12.31 g of octyl oxalylchloride in 15 ml of acetonitrile is added to 18.42 g of hydroquinone and 4.41 g of pyridine in 200 ml of acetonitrile at below 15° C. After allowing the mixture to warm to room temperature, the solvent is removed in vacuum, and 200 ml of water are added to the residual yellow oil. A granular solid gradually appears. This is dissolved in dichloromethane, washed with water, and the solvent evaporated. Yield 12.1 g melting point 72°-76° C.

EXAMPLE

Preparation of a solid dispersion of the compound of the formula A

The following mixture is prepared:

1 g of the compound of the formula A
10 ml distilled water
0,25 ml 30% anionic wetting agent
50 ml 2 mm glass beads The above ingredients are added to a 100 ml beaker and bead milling is effected by agitating the glass beads with a stirrer rotating at 1000 r.p.m. for 25 hours. At the end of this time the glass beads are removed by filtration.

Coatings of this dispersion are prepared as follows:

10 ml aliquots of coating solution are made up according to the formula:

2 ml solid dispersion (prepared as described above)
0.90 ml silver chlorobromide emulsion (Ag 25 mg/dm$^2$)
0.50 ml 10% gelatin (decationised blend)
1 ml 1% aqueous formaldehyde solution
0.15 ml 1% anionic wetting agent
0.15 ml 1% anionic wetting agent
Water to 10 ml The solution is coated at 40° C. on triacetate base attached to a glass plate, set at 5° C. and dried.

| | |
|---|---|
| Overall silver coating weight | 25 mg/dm$^2$ |
| Overall gelatin coating weight | 80 mg/dm$^2$ |
| Overall compound of the formula A coating weight | 285 mg/dm$^2$ |

Similar coatings of the compounds of the formulae B to L are also prepared.

Two sets of the coatings of the compounds of the formula A, B, C, D, E and F are exposed in an overall manner. The coatings are treated with an activator solution comprising in one liter:

| | |
|---|---|
| 42,4 g | $Na_2CO_3$ |
| 21.0 g | $NaHCO_3$ |
| 25.0 g | $Na_2SO_3$ |
| 0.2 g | 1-Phenyl-3-pyrazolidinone. |

The solution is adjusted to a pH-value of 10.

One set of coatings it treated with this solution for 10 seconds and the other set for 60 seconds in a processing bath.

All the coatings are then washed, fixed in a solution containing 82 g/l of ammonium thiosulphate for 2 minutes, washed and then dried. The silver densities obtained by this method for the various coatings are tabulated below.

TABLE 1

| Compound of the formula | Silver Density D. max 10 Seconds | 60 Seconds |
|---|---|---|
| A | 0.47 | 1.94 |
| B | 0.77 | 1.57 |
| C | 0.20 | 1.63 |
| D | 0.19 | 1.18 |
| E | 0.51 | 1.75 |
| F | 0.22 | 1.18 |

These results show good D. max values obtained at both long and short processing times.

One set of coatings G, H, I, J, K and L are exposed in an overall manner and treated as above set forth in an activator solution for 60 seconds, fixed and washed as above. However none of these coatings are found to exhibit a particularly high density. Thus a further set of coatings G, H, I, J, K and L are exposed in an overall manner and treated with an activator solution consisting of 2 molar NaOH (pH 14) for 20 seconds.

All the coatings are then washed, fixed in an ammonium thiosulphate (82 g/l) solution for 2 minutes in a bath, washed and then dried. The silver densities obtained by this method for the various coatings are tabulated below.

TABLE 2

| Compound | Silver Density (D. max) |
|---|---|
| G | 2.90 |
| H | 3.18 |
| I | 2.24 |
| J | 1.86 |
| K | 2.48 |
| L | 2.54 |

Thus, at this higher pH-value all these compounds exhibit good reactivity.

We claim:

1. Photographic material which comprises in at least one silver halide emulsion layer or a layer or layers adjacent thereto at least one substituted hydroquinone compound of the formula

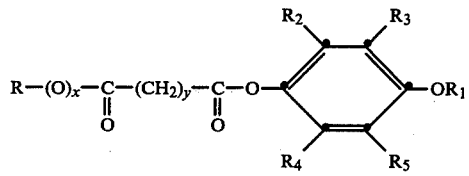

where

R is hydrogen or optionally substituted methyl or ethyl, aryl or a heterocyclic group, $R_2$, $R_3$, $R_4$ and $R_5$ are each hydrogen,
x is 0 or 1,
y is 0 or 1,
and $R_1$ is hydrogen or a group of the formula $$R-(O)_x-\underset{\underset{O}{\|}}{C}-(CH_2)_y-\underset{\underset{O}{\|}}{C}-,$$

with the proviso that if R is methyl only one of x and y can be 0.

2. Photographic material according to claim 1, wherein R is hydrogen or methyl or ethyl which are unsubstituted or substituted by alkoxy having 1 to 18 carbon atoms, phenyl, phenoxy, hydroxyl, halogen, amino, or N-alkyl- or N,N-dialkylamino wherein the alkyl radicals contain 1 to 18 carbon atoms or R is phenyl or biphenyl which radicals are unsubstituted or substituted by alkoxy having 1 to 18 carbon atoms, phenyl, phenoxy, hydroxyl, halogen, amino, or N-alkyl- or N,N-dialkylamino wherein the alkyl radicals contain 1 to 18 carbon atoms or R is a 5- or 6-membered heterocyclic ring containing a nitrogen or oxygen atom.

3. Photographic material according to claim 2, wherein R is hydrogen or methyl or ethyl which are unsubstituted or substituted by phenyl, hydroxyl or halogen, or R is phenyl which is unsubstituted or substituted by hydroxyl or halogen or R is a pyridine, furyl or pyrrolidine radical.

4. Photographic material according to claim 3, wherein R is hydrogen, methyl, ethyl; or phenyl or hydroxyphenyl.

5. Photographic material according to claim 4 where each of $R_1$, $R_2$, $R_3$, $R_4$ and $R_5$ are hydrogen.

6. Photographic material according to claim 1 where R is p-hydroxy phenyl.

7. Photographic material according to claim 1 which comprises in at least one silver halide emulsion layer or a layer or layers adjacent thereto at least one compound of the formulae

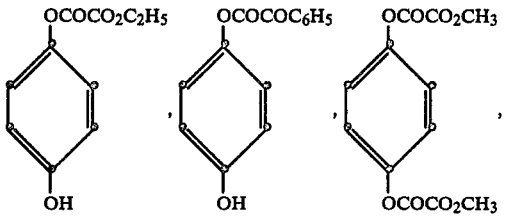

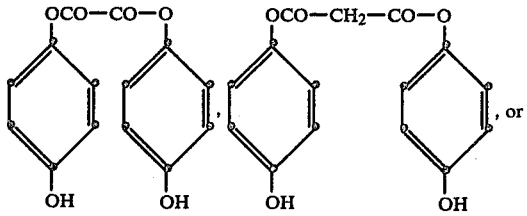

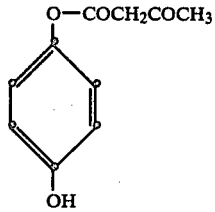

8. Photographic material according to claim 1 where the substituted hydroquinone compound is present in a silver halide emulsion layer.

9. Photographic material according to claim 1 wherein the substituted hydroquinone compound is present in at least one silver halide emulsion layer or in a layer or layers adjacent thereto as a solid dispersion which has been obtained by ball-milling the solid hydroquinone in an aqueous medium in the presence of a wetting agent.

10. Process for the preparation of a photographic material containing in at least one silver halide emulsion layer or a layer or layers adjacent thereto at least one substituted hydroquinone compound of the formula

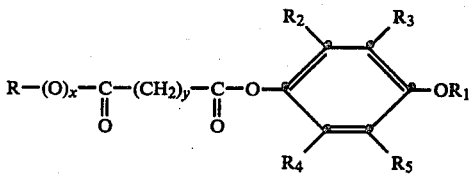

where

R is hydrogen or optionally substituted methyl or ethyl, aryl or a heterocyclic group, $R_2$, $R_3$, $R_4$ and $R_5$ are each hydrogen, x is 0 or 1, y is 0 or 1, and $R_1$ is hydrogen or a group of the formula

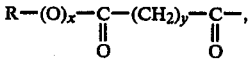

with the proviso that if R is methyl only one of x and y can be 0 which comprises coating onto a support at least one silver halide emulsion layer and optionally a layer or layers adjacent thereto, the silver halide emulsion layer or optionally the layer(s) adjacent thereto comprising at least one of said substituted hydroquinone compounds in form of a solid dispersion or solution.

11. A method of processing a photographic material containing in at least one silver halide emulsion layer or a layer or layers adjacent thereto at least one substituted hydroquinone compound of the formula

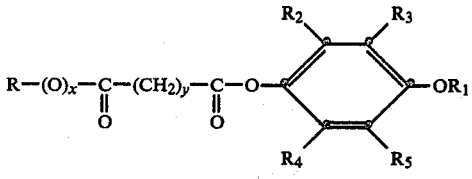

where

R is hydrogen or optionally substituted methyl or ethyl, aryl or a heterocyclic group, $R_2$, $R_3$, $R_4$ and $R_5$ are each hydrogen, x is 0 or 1, y is 0 or 1, and $R_1$ is hydrogen or a group of the formula with the proviso that if R is methyl only one of x and y can be 0 which comprises treating the exposed material with an aqueous alkaline activator solution and fixing the material in a silver halide fixing solution.

* * * * *

UNITED STATES PATENT AND TRADEMARK OFFICE

CERTIFICATE OF CORRECTION

PATENT NO. : 4,446,216

DATED : May 1, 1984

INVENTOR(S) : Norman A. Smith et al

It is certified that error appears in the above-identified patent and that said Letters Patent is hereby corrected as shown below:

| | |
|---|---|
| 1st Page, after "Inventors" | Insert--[73] Assignee<br>Ciba Geigy AG<br>Basle, Switzerland-- |
| Col. 9, line 40 | Delete "0.2g" and substitute<br>--0,2g-- |

Signed and Sealed this

*Twenty-fifth* Day of *December 1984*

[SEAL]

*Attest:*

*Attesting Officer*

GERALD J. MOSSINGHOFF

*Commissioner of Patents and Trademarks*